United States Patent [19]

Green et al.

[11] 4,009,113

[45] Feb. 22, 1977

[54] PROTECTION OF MATERIALS

[75] Inventors: Robin John Green, Birkenhead; Richard Shaw Johnson, Wirral, both of England

[73] Assignee: Lever Brothers Company, New York, N.Y.

[22] Filed: Feb. 25, 1974

[21] Appl. No.: 445,753

Related U.S. Application Data

[63] Continuation of Ser. No. 247,127, April 24, 1972, abandoned.

[30] Foreign Application Priority Data

Apr. 30, 1971 United Kingdom ..... 12379/71

[52] U.S. Cl. ..... 252/95; 252/102; 252/103; 252/174; 252/186; 252/544; 252/546; 252/550; 252/555; 252/558

[51] Int. Cl.[2] ..... C11D 9/42

[58] Field of Search ..... 252/95, 99, 186, 89, 252/102, 186, 103, 174, 544, 546, 550, 555, 558

[56] References Cited

UNITED STATES PATENTS

| | | | |
|---|---|---|---|
| 3,338,839 | 8/1967 | MacKeller | 252/186 |
| 3,637,339 | 1/1972 | Gray | 252/99 X |
| 3,639,248 | 2/1972 | Moyer et al. | 252/186 |
| 3,660,295 | 5/1972 | LaBarge et al. | 252/186 X |
| 3,661,789 | 5/1972 | Corey et al. | 252/186 |

FOREIGN PATENTS OR APPLICATIONS

| | | |
|---|---|---|
| 676,777 | 12/1963 | Canada |
| 907,358 | 10/1962 | United Kingdom |
| 1,204,123 | 9/1970 | United Kingdom |

*Primary Examiner*—Thomas J. Herbert, Jr.
*Assistant Examiner*—Bruce H. Hess
*Attorney, Agent, or Firm*—Kenneth F. Dusyn; James J. Farrell; Melvin H. Kurtz

[57] ABSTRACT

The disclosure relates to the protection of solid precursors in powder detergent compositions using a hydrogen peroxide bleach system. The finely divided precursor is formed, with a carrier material, into a composite particle which is then coated. The coated particle gives good dispersion of the precursor in the wash liquor.

18 Claims, No Drawings

PROTECTION OF MATERIALS

This is a continuation, of application Ser. No. 247,127, filed Apr. 24, 1972 now abandoned.

This invention relates to detergent and bleaching compositions. In order to provide bleaching during the wash cycle, detergent compositions contain bleaching materials.

A class of bleaching materials which are used is that which provides hydrogen peroxide in solution. Examples of this class are sodium perborate, sodium percarbonate and urea hydrogen peroxide. A commonly used material is the perborate. In order to increase the bleaching effect of, for example, perborate at temperatures below 60° C, a so-called bleach precursor has been proposed as an additive to detergent compositions. A precursor (as it will be called hereafter) is believed to react with the hydrogen peroxide to form a bleaching species active at these lower temperatures. Examples of solid precursors are carboxylic acid anhydrides, for example succinic, benzoic and phthalic anhydrides; carboxylic acid esters, for example sodium acetoxy benzene sulphonate, sodium para sulphonated phenyl benzoate and acetyl salicylic acid; N-acyl substituted amides, for example tetra acetyl ethylene (or methylene) diamine and the glyco urils.

The precursor being a hydrolysable material will need to be protected from the aqueous and alkaline components of the detergent composition during storage. This protection will also ensure the precursor does not react during storage with the hydrogen peroxide releasing compound. The present invention is of particular value in the protection of the anhydrides and esters.

Any method of protecting the precursor against the alkaline environment must allow dissolution of the precursor in the wash liquor. Release of the precursor must be achieved at a period before the end of the wash cycle so as to give time for the bleaching step to occur. Thus, with a wash cycle at 40° C phthalic anhydride, being used as the precursor, should be completely released at least 5 minutes before the end of the wash cycle. Hereafter the invention will describe the type of materials used to obtain protection and it will be appreciated by the reader how the description can be modified to give the desired release characteristics. When the precursor has been exposed to the wash liquor, solution of the precursor is normally required as soon as possible, but protection can be selected to give release after a selected time interval.

The invention provides a powder detergent composition comprising a hydrogen peroxide releasing material, and precursor-containing bodies containing at least 40% by weight of precursor and having a diameter from about 0.3 mm to about 3.00 mm comprising an outer protective coherent layer surrounding a dispersible composite particle, containing finely divided precursor material, which passes a mesh size of about 0.15 mm, and a carrier material.

The precursor is desirably of as small a particle size as possible and preferably passes a mesh of 0.05 mm. From consideration of powder handling the effective lower limit is about 0.001 mm.

Preferably the precursor is present in an amount of at least 60% by weight in the precursor-containing bodies. The practical upper limit is about 80% by weight.

Alkaline components from which protection is sought are, for example, silicates and builder salts such as phosphates. In some instances the hydrogen peroxide releasing material is itself also alkaline, for example sodium perborate and sodium percarbonate. Thus the compositions defined by the invention include those wherein the alkaline properties are obtained from the hydrogen peroxide releasing material.

The term "powder" includes, eg granulates, extrudates and particles. The size range of the precursor-containing bodies is selected so that it does not segregate in the powder composition of normal particle size, ie broad distribution below 1 mm.

The detergent active present in the composition may be a single active or a mixture of actives. The active may be selected from the anionic, cationic, nonionic, amphoteric or zwitterionic groups. Examples are alkaryl sulphonates (eg dodecyl benzene sulphonate), products of the sulphonation of olefins, alcohol sulphates, ethexylated alcohols and alkali metal salts of long chain fatty acids (soaps). Other detergent actives are described in the books "Surface Active Agents and Detergents" Vols. I and II by Schwartz, Perry and Berch (published by Interscience).

Detergency builders, for example phosphates (eg sodium tripolyphosphate, sodium orthophosphate), carbonates and organic builders, eg nitrilotriacetic acid and its water soluble salts, may also be present.

The use of the term "alkaline" means that the composition dissolves in water to give a solution of above 7 pH and preferably pH 8 to pH 10. These alkalinities being achieved when the composition is used in the usual in-use concentrations from 0.15% to 0.6% weight/volume.

The invention also extends to a method of forming stable, water dispersible precursor-containing bodies suitable for inclusion in a detergent composition wherein powdered precursor passing mesh size of 0.15 mm is formed into composite particles having a diameter from about 0.3 mm to about 3.00 mm with a carrier material and the composite particles are coated to form an outer protective coherent layer.

The use of a dispersing aid in combination with finely divided precursor ensures rapid solution of the precursor after the composite particle is exposed to the wash liquor. The precursor will then react efficiently with the hydrogen peroxide present in the liquor.

The invention prevents contact between the precursor and alkaline components of the detergent composition which initiate decomposition by formation of salts, usually the sodium salts, of the acids corresponding to the precursor, eg sodium benzoate, phthalate, succinate and acetate. These salts, being hygroscopic relative to the inorganic salt hydrates normally present, introduce water at the site of the initial reaction. In the case of the acid anhydrides and esters this water causes further attack leading to penetration of the entire precursor-containing body. Amides are only attacked by aqueous alkali so that further reaction can proceed only slowly and may therefore be insignificant.

In Canadian pat. specification No. 676,777, assigned to the Pillsbury Company, there are described methods of protecting carboxylic acid anhydrides against the alkaline environment found in a detergent composition. Although this specification claims good stability of the anhydrides over relatively short periods of time, the products will not be entirely satisfactory because of slow solution of the precursor into the bleaching liquor, or low concentration of precursor in the protected tablets. This low concentration necessitates high dosages to provide a useful amount of the precursor in the wash liquor.

UK pat. specification No. 907,358 (Noury) discloses coating a precursor, eg tetra acetyl methylene diamine, with a water soluble material, eg a polyethylene glycol. The product of this description, while being protected from the environment, has a slow rate of solution.

In UK pat. specification No. 1,204,123 there is described a method of protecting an adjunct in detergent compositions. The present invention describes the specific means required to protect solid precursors in this environment.

The present invention provides protection of the precursors while giving good solution characteristics.

The solid precursor may first be mixed with a carrier material to provide composite particles having the components evenly distributed in the bulk. An excess of carrier material at the particle surface, while not essential, does provide additional protection. The particles are then coated with a coating material to form a coherent protective outer layer.

Although a two-step process is envisaged the invention also contemplates the body being formed in a single-step process to produce a body having the same material as both carrier material and outer protective layer.

The particles are preferably spheronised during or before the coating process to provide consistent thickness to the coating. The presence of a consistent thickness in the coating layer ensures release over a short and controllable time period.

The invention contemplates, in addition to the use of a precursor-containing body in a detergent formulation, the use of such a body in admixture with an alkaline hydrogen peroxide releasing compound with a relatively small amount of detergent active. Such a composition would be used as a separate bleach formulation.

The carrier material, which may be a mixture, must be workable to form a shape, in admixture with the precursor, for example in an extrusion process, spheronisation process or granulation process. The carrier materials must be inert at ambient temperatures, that is to say they must not be reactive with, nor a solvent for, the precursor. The carrier material must also be soluble in, or dispersible in (if necessary with a dispersing aid), aqueous detergent solution.

The carrier material may be a liquid. In this case the composite particle can be prepared by simple admixture of the precursor with the liquid material. The particles may be formed either in a separate process after the mixture is formed, or during the mixing process. The Applicants have found that a precursor may be mixed with a liquid carrier material to produce composite particles in a one-step process using a machine termed a "Marumeriser" made by Fuji Paudal KK (formerly Fuji Denki Kogyo KK). A "Marumeriser" machine comprises a smooth verticle cylinder with a rotatable roughened plate in its base. Rotation of the base plate can cause granulation of a powder on addition of a binder (liquid carrier material). The base plate may be roughened by, for example, grooves or sand blasting. The machine will also spheronise extrudates, which are broken down into lengths approximately equal to the diameter during formation of the spheres, and coat spherical particles. It has been found, for example, that phthalic anhydride can be formed into composite particles using liquid paraffin and sodium lauryl sulphate as the carrier material.

The carrier material (which may be a mixture) must not be hygroscopic under the storage conditions. Suitable materials which are usable as components in the carrier materials are paraffins and certain long chain fatty acids and esters, eg lauric acid, sodium dodecyl hydrogen phthalate and sodium dodecyl hydrogen succinate. In general, acids and esters having chain lengths above $C_8$ are preferred. Specific dispersing aids may be included in the carrier material, but some components, for example paraffins, can only be used with a dispersing aid. These aids will assist in the dispersion of the precursor through the wash liquor when the composite particle is exposed following dissolution of the outer protective layer. Examples of suitable dispersing agents are sodium alkyl sulphates, sodium alkylaryl sulphonates and sodium olefin sulphonates.

The coating material used to form the protective layer must be capable of forming a coherent layer on the composite particle. A coherent layer is necessary to prevent aqueous alkali contacting the precursor. The outer protective layer, ie coating material and the optional plasticiser, must not be deliquescent and it will preferably rave a low water vapour permeability.

Suitable coating materials are poly(vinyl alcohol), poly (acrylamide), certain copolymers of acrylic acid, methacrylic acid or maleic anhydride (the homopolymers of these materials are hygroscopic and must not be used), starch and its modifications and derivatives, for example dextrins and low viscosity starches, water soluble cellulose ethers such as methyl cellulose, hydroxyethyl cellulose, gelatin and water soluble gums such as gum arabic and gum tragacanth; dextrin or sucrose are preferred.

The choice of plasticisers for these materials will depend on the coating material selected. Where a plasticiser is necessary it may be one of urea, a polyhydric alcohol such as glycerol, ethylene glycol, propylene glycol, hexylene glycol, certain esters of dibasic acids, eg dibutyl phthalate, di-octyl maleate, di-hexyl succinate, and of phosphoric acid, eg tri-t-butoxyethyl phosphate. The level of plasticiser required is such that a coating which is coherent under all conditions of storage is obtained.

The thickness of the protective layer will be selected to give the desired stability in storage and can control the required release properties in the wash liquor. It is required that the protective layer should have sufficient tensile strength to resist damage during any of the processes involved in mixing the coated precursor with the detergent powder and in packaging and transporting the product.

Examples to illustrate the invention will now be given together with comparative Examples.

EXAMPLE 1

A mixture of 69 parts of powdered phthalic anhydride passing a mesh of size 0.15 mm, 29 parts lauric acid and 2 parts fully hardened coconut fatty acid was extruded through a 1 mm screen. The noodles produced were spheronised in a Marumeriser with a grooved base plate of 23 cm diameter to produce spherical particles the majority of which had a diameter of about 1 mm. 500 g of the spheres prepared were coated in the Marumeriser, using a slightly roughened base plate, with 250 ml of an aqueous solution containing 25 g of poly(vinyl alcohol) of molecular weight 14000 (produced by 88% hydrolysis of poly(vinyl acetate), and 12.5 g of sodium lauryl sulphate. A current of hot air was directed at the bed to effect drying. It was found that the anhydride was released into a stirred aqueous alkaline solution (pH 10) at 40° C very rapidly and its solution was almost complete within twenty minutes.

15 parts of the coated phthalic anhydride were mixed with 85 parts of the detergent base, having the following composition:

| Detergent base powder | % |
|---|---|
| Detergent active (a mixture of alkyl benzene sulphonate, tallow alcohol 18 EO and tallow soap) | 16.0 |
| Sodium silicate | 13.0 |
| Sodium sulphate | 11.0 |
| Sodium tripolyphosphate | 34.0 |
| Water (as hydrate in inorganic materials) | 14.0 |
| Sodium perborate tetrahydrate | 12.0 |
| | 100.0 |

After storage in a sealed glass vessel for 3 weeks at 37° C, 59% of the original phthalic anhydride (as determined by NMR) remained. In a control test using unprotected anhydride, all the precursor as lost in this period.

The coated spheres were tested for continuity of the protective layer by soaking them for ten minutes in about 5 cc of acetone, which is a solvent for phthalic anhydride but not for the coating material. A few drops of the acetone were evaporated down on a glass slide and examination of the slide on a microscope revealed no phthalic anhydride crystals deposited as the acetone evaporated.

EXAMPLE 2 (COMPARATIVE)

This Example demonstrates preparation of a precursor-containing body having good storage properties but poor release properties.

300 g of phthalic anhydride granules, passing mesh size 2 mm retained on imm, were placed in the rotating pan of a bench-scale coater. The tumbling bed of the anhydride granules were sprayed with 300 ml of an aqueous solution containing 30 g of poly(vinyl alcohol) of molecular weight = 14,000 (this polymer was produced by hydrolysis of poly(vinyl acetate) to 88% completion) and 15 g of sodium lauryl sulphate, which serves as an aid to wetting the surface of the anhydride as well as facilitating dispersion in the wash solution. The spraying operation was carried out slowly, drying the bed continually with hot air, to prevent agglomeration of the granules. Final traces of water were removed with the hot air.

15 parts of the coated phthalic anhydride were mixed with 85 parts of the detergent base powder quoted in Example 1 and stored at 37° C in a sealed glass flask. The powder was analysed for phthalic anhydride at weekly intervals, and no loss of the anhydride could be detected after four weeks. In a control experiment using uncoated anhydride granules, complete decomposition occurred within 2 weeks.

The irregular nature of the granules of phthalic anhydride caused non-uniformity in the thickness of the coating. Release of the anhydride into a aqueous alkaline solution (pH 10) at 40° C began almost immediately, but because of the large particle size of the anhydride the release was slow, and more than 60 minutes was required for all the anhydride to become available in solution.

EXAMPLE 3 (COMPARATIVE)

This example demonstrates that extrusion and spheronisation of phthalic anhydride with a suitable carrier system results in some, but not sufficient, improvement lauryl stability.

A mixture of 75 parts phthalic anhydride (passing mesh size of 0.15 mm), 12.5 parts sodium laury sulphate and 12.5 parts lauric acid was extruded through a 1.5 mm screen. The noodles produced were spheronised in a Q230 Marumeriser having a grooved base plate of 23 cm diameter at 35° C. The spheres had a diameter of about 1.5 mm.

The anhydride was almost completely released into a stirred aqueous alkaline surfactant solution (pH 9.5) at 40° C within 10 minutes. The uncoated spheres were stored in laminated cartons in the same detergent base powder as in Example 1 at 37° C/70% RH. 50% decomposition of the anydride occurred in 18 days.

EXAMPLE 4

The example demonstrates acceptable storage due to a coherent coating of poly(vinyl alcohol).

500 g of the spheres produced in Example 3 were recharged to the Marumeriser fitted with a slightly roughened base plate, operated at 350 rpm. 470 ml of an aqueous solution containing 70 g of the poly(vinyl alcohol) used in Example 1 was added dropwise to the moving bed of spheres over a period of 2 hours, drying the bed continually with hot air.

The continuity of the coating was tested by soaking 1 g of the spheres for 10 minutes in 10 cc of 1,4-dioxan, which is a solvent for phthalic anhydride but not for poly(vinyl alcohol). A few drops of the dioxan were evaporated down on a glass slide, and examination of the slide on a microscope revealed no phthalic anhydride crystals.

After storage for 3 months in the detergent base powder at 37° C/70% RH in laminated cardboard cartons, only 3% of the original phthalic anhydride was decomposed. 90% of the phthalic anhydride was dissolved in a stirred aqueous solution after 22 minutes at 40° C (pH of 10).

EXAMPLE 5

500 g of the spheres produced in Example 3 were charged into the Marumeriser fitted with a slightly roughened base plate which was set in motion at 350 rpm. Over a period of 15 minutes 74 ml of an aqueous solution containing 34.7 g Encapsul grade yellow dextrin (obtainable from Laing National Starch Ltd., Manchester) and 10.4 g glucose was poured onto the rolling bed of granules whilst dusting intermittently with Alusil (an alumina-silica obtainable from J. Crosfield & Sons Ltd., Warrington) (total wt. used = 30.7 g) to retain the free-flowing properties of the bed.

The spheres were then discharged into a fluid bed dryer where the water used to apply the solution was removed at 40° C.

After storage for 3 months at 37° C/70% RH in laminated cartons in the detergent base powder, only 7% of the original phthalic anhydride had decomposed. 90% of the phthalic anhydride was dissolved in a stirred aqueous solution after 8 minutes at 40° C (pH of 10).

EXAMPLE 6

A mixture of 80 parts phthalic anhydride (passing mesh size 0.15 mm), 10 parts sodium lauryl sulphate and 10 parts liquid paraffin was extruded through a 0.8 mm screen. The noodles produced were spheronised in the Marumeriser at room temperature using the grooved base plate, 500 g of the spheres obtained were then coated in the Marumeriser, using a slightly roughened base plate, as described in Example 5. The spheres had a diameter of about 0.8 mm.

In a stirred aqueous solution at 40° C (pH 10), 90% of the anhydride was dissolved within 9 minutes. After storage for 3 months at 37° C/70% RH in the detergent base powder in laminated cardboard cartons, only 10% of the original phthalic anhydride was decomposed.

EXAMPLE 7

A mixture of 75 parts tetra acetyl ethylene diamine (TAED) passing mesh size 0.10 mm, 20 parts sodium lauryl sulphate and 5 parts dodecyl hydrogen succinate as extruded through a 0.8 mm screen. The noodles produced were spheronised using a grooved base plate in a Marumeriser at room temperature. Then, using a slightly roughened base plate, 1 Kg of the spheres was coated with 112 ml of an aqueous solution containing 51 g of Encapsul grade yellow dextrin and 15.2 urea, adding this solution to the rolling bed of particles over a period of 8 minutes whilst dusting with Alusil (total wt used = 90 g) to maintain the free-flowing properties of the bed. The spheres had a diameter of about 0.8 mm.

90% of the TAED was dissolved in a stirred aqueous solution containing sodium perborate at 40° C (pH 10) within 3.5 minutes. (This compared with 10 minutes for the unprotected TAED powder.) After storage for 3 months in the detergent base powder at 37° C/70% RH in laminated cardboard cartons, no decomposition could be detected.

EXAMPLE 8

800 g phthalic anhydride (passing mesh size 0.15 mm) and 100 g sodium lauryl sulphate were charged into the Marumeriser fitted with the grooved base plate. This was set in motion at 1200 rpm and 100 g liquid paraffin was poured onto the moving powder bed. After 5 minutes, the spheronised granules produced were discharged, sieved and the fraction passing 1.2 mm mesh, retained on 0.6 mm mesh was collected. 500 g of these granules were replaced in the Marumeriser fitted with the slightly roughened base plate and coated as described in Example 5.

In a stirred aqueous solution at 40° C (pH 10), 90% of the anhydride was dissolved in 8 minutes. After storage for 3 months in the detergent base powder at 37° C/70% RH in laminated cardboard cartons, only 8% of the original phthalic anhydride was decomposed.

The methods by which the carrier material and coating material are selected for suitability are given hereafter.

TEST METHODS

1. Carrier materials

To test for interactions between the precursor and the proposed carrier material, an intimate mixture of the two in the proportions anticipated is placed in an open ended test tube. This in turn is placed inside a larger vessel containing the detergent powder such that the carrier/precursor mixture does not come into contact with the detergent powder but is open to the atmosphere within the outer vessel. The outer vessel is sealed to isolate it from the external atmosphere and stored at the temperatures anticipated for the product. Samples of the mixture are removed at weekly intervals for analysis. Any interaction is detected by a loss of the precursor.

2. Coating materials a. A preliminary test for whether a coating material will form a coherent film is carried out as follows:

A solution of the coating material is prepared, containing any suitable plasticiser which may be required, and a glass slide is dipped into this solution and then allowed to drain. The slide is then dried in a current of warm air and the film which is deposited is examined for cracks or other defects.

b. The conerency of the coating after application to the composite particle is tested as follows:

1 g of the coated particles are placed in 100 ml of a solvent for the precursor which, at the same time is not a solvent or swelling agent for the coating material. After 10 minutes a drop of the solvent is removed and evaporated to dryness on a glass slide. The slide is examined under an optical microscope for deposition of the precursor as the solvent evaporates. If the coating is coherent, no such deposition is observed.

What is claimed is:

1. An alkali stable, water dispersible, precursor-containing body for use in an alkaline powder detergent composition, consisting essentially of:

a. about 40% to about 80% by weight of the body of a finely divided, particulate precursor compound capable of reacting with hydrogen peroxide in an aqueous medium that will form a peracid bleaching species below 60° C, said particulate precursor compound being capable of passing through a mesh screen of about 0.15 mm; and b. an inert carrier material of lauric acid, sodium dodecyl hydrogen phthalate, sodium dodecyl hydrogen succinate, sodium lauryl sulphate, or liquid paraffin, said carrier material being substantially evenly distributed with said precursor compound to form a composite particle having an outer protective, non-deliquescent, coherent layer of polyvinyl alcohol, a polyacrylamide, a starch, a water-soluble cellulose ether or a water-soluble gum for preventing aqueous alkaline attack on said precursor compound;

said precursor-containing body having a diameter of from about 0.3 mm to about 3.00 mm.

2. The precursor-containing body defined in claim 1 wherein the precursor is present in an amount of from about 60% to about 80% by weight of said body.

3. The precursor-containing body defined in claim 1 wherein the precursor is a carboxylic acid anhydride.

4. The precursor-containing body defined in claim 3 wherein the precursor is phthalic anhydride.

5. The precursor-containing body defined in claim 1 wherein the precursor is a carboxylic acid ester.

6. The precursor-containing body defined in claim 1 wherein the precursor is an N-acyl substituted amide.

7. The precursor-containing body defined in claim 6 wherein the precursor is tetra acetyl ethylene diamine.

8. The precursor-containing body defined in claim 1 wherein the precursor is a glycol uril.

9. The precursor-containing body defined in claim 5 wherein the composite particle additionally contains a dispersing aid compound selected from the group consisting of sodium alkyl sulphates, sodium akylaryl sulphonates and sodium olefin sulphonates.

10. The precursor-containing body defined in claim 9 wherein the dispersing aid compound is sodium lauryl sulphate.

11. The precursor-containing body defined in claim 9 wherein the precursor compound is phthalic anhydride or tetra acetyl ethylene diamine; the dispersing aid is sodium lauryl sulphate; the carrier material is lauric acid, sodium dodecyl hydrogen phthalate, sodium dodecyl hydrogen succinate, or liquid paraffin; and the outer protective layer is polyvinyl alcohol, dextrin or glucose.

12. A powder detergent composition comprising an anionic, cationic, nonionic, amphoteric or zwitterionic detergent active compound, or mixtures thereof, and a hydrogen peroxide releasing material and precursor-containing body according to claim 1.

13. A method of forming a stable, water dispersible, precursor-containing body for use in an alkaline powder detergent composition, comprising the steps of:

a. admixing and evenly distributing from about 40 to about 80% by weight of the total body of a finely divided particulate precursor compound
   i. capable of reacting with hydrogen peroxide in an aqueous medium that will form a peracid bleaching active below 60° C, and
   ii. capable of passing through a mesh screen of about 0.15 mm;

with an inert carrier material of lauric acid, sodium dodecyl hydrogen phthalate, sodium dodecyl hydrogen succinate, sodium lauryl sulphate, or liquid paraffin to form a dispersible composite particle; and b. coating said composite particle with an outer-protective, non-deliquescent, coherent layer of polyvinyl alcohol, a polyacrylamide, a starch, a water-soluble cellulose ether or a water-soluble gum, for preventing aqueous alkaline attack with said precursor compound, thereby forming the precursor-containing body, said body having a diameter of from about 0.3 mm to about 3.00 mm.

14. A method according to claim 13 wherein the precursor-containing body contains at least 60% by weight of the precursor compound.

15. A method according to claim 13 wherein the precursor compound is a carboxylic acid anhydride, a carboxylic acid ester, an N-acyl substituted amide or a glycol uril.

16. A method according to claim 15 wherein the precursor compound is phthalic anhydride or tetra acetyl ethylene diamine.

17. A method according to claim 13 wherein a dispersing aid compound selected from the group consisting of sodium alkyl sulphates, sodium akylaryl sulphonates and sodium olefin sulphonates is additionally admixed with the precursor compound and carrier to form said composite particle.

18. A method according to claim 13 wherein the composite particle is subjected to a spheronization step prior to being coated with said outer protective layer.

* * * * *